United States Patent [19]

Lohman et al.

[11] 4,121,927

[45] Oct. 24, 1978

[54] METHOD OF PRODUCING HIGH CARBON HARD ALLOYS

[75] Inventors: Gordon Russell Lohman, Glen Ellyn; James E. Hansen, Elmwood Park, both of Ill.

[73] Assignee: AMSTED Industries Incorporated, Chicago, Ill.

[21] Appl. No.: 651,554

[22] Filed: Jan. 22, 1976

Related U.S. Application Data

[63] Continuation-in-part of Ser. No. 454,601, Mar. 25, 1974, abandoned.

[51] Int. Cl.[2] ..... B22F 3/16

[52] U.S. Cl. ..... 75/201; 29/420.5; 75/0.5 C; 75/200; 75/213; 75/241; 148/126

[58] Field of Search ..... 75/200, 213, 201, 0.5 C, 75/214, 241, 203; 148/126; 29/420.5

[56] References Cited

U.S. PATENT DOCUMENTS

| | | | |
|---|---|---|---|
| 3,150,444 | 9/1964 | Reen | 29/420.5 |
| 3,561,934 | 2/1971 | Steven | 75/203 |
| 3,725,142 | 4/1973 | Huseby | 148/126 X |
| 3,744,993 | 7/1933 | Matt et al. | 75/213 |
| 3,846,126 | 11/1974 | Foley et al. | 75/211 |
| 3,887,402 | 6/1975 | Kondo et al. | 148/126 |
| 3,889,350 | 6/1975 | Mocarski | 75/226 X |

FOREIGN PATENT DOCUMENTS 1,466,249 3/1977 United Kingdom.

OTHER PUBLICATIONS

Dulis et al., "New Improved High-Speed Tool Steels by Particle Metallurgy Progress in Powder Met.," vol. 28, 1972.

Powderex Limited Information Circular, "High Speed Steels From Powder Metals".

Kelley, E. W., "Powder Metallurgy and the Superalloys," in the Int. Journal of Powd. Met. & Powd. Tech., vol. 10, #1, Jan. 1974.

Lange, N. A., "Handbook of Chemistry", 10th Ed., 1961, McGraw-Hill, N.Y. pp. 864-865.

Guy, A. G., "Elements of Physical Metallurgy," 2nd Ed. 1959, Addison-Wesley, Reading, Mass., p. 213.

*Primary Examiner*—Richard E. Schafer

*Attorney, Agent, or Firm*—Fred P. Kostka

[57] ABSTRACT

A method for forming high carbon hard alloys using powdered metal techniques wherein the carbon content of the atomized powdered metal particles is minimized and the carbon content to achieve the desired composition is provided by blending carbon or carbon containing powder with the powdered metal particles prior to compaction and sintering. The compact may be sintered just above the solidus temperature of the alloy.

11 Claims, 1 Drawing Figure

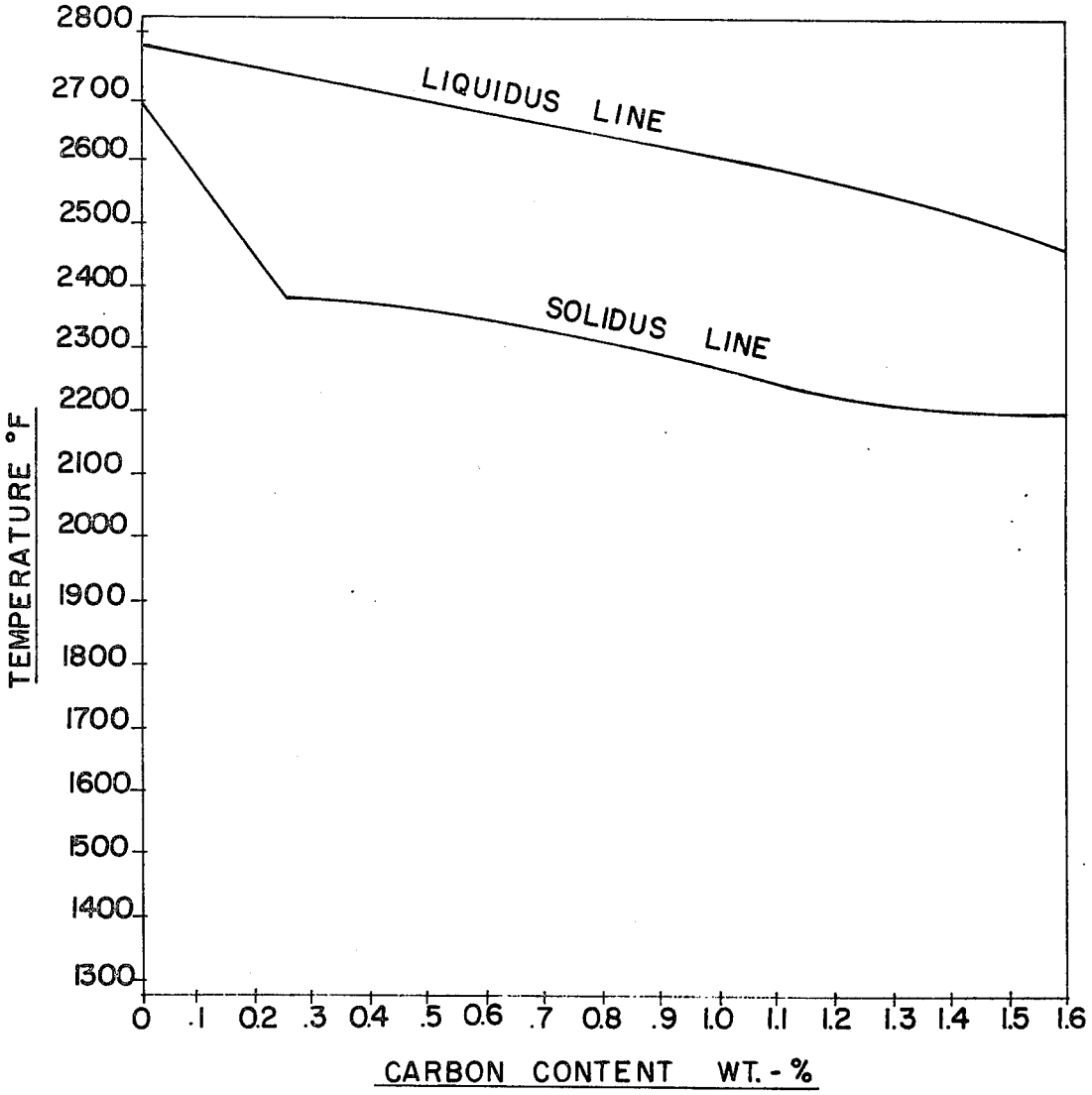
2800
2700
2600
2500
2400
2300
2200
2100
2000
1900
1800
1700
1600
1500
1400
1300
TEMPERATURE °F
LIQUIDUS LINE
SOLIDUS LINE
0
.1
0.2
.3
0.4
.5
0.6
.7
0.8
.9
1.0
1.1
1.2
1.3
1.4
1.5
1.6
CARBON CONTENT WT.-%

METHOD OF PRODUCING HIGH CARBON HARD ALLOYS

BACKGROUND AND SUMMARY OF THE INVENTION

This application is a continuation in part of our copending application Ser. No. 454,601 filed Mar. 25, 1974, now abandoned.

The present invention relates to an improved method for making high carbon hard alloys by the use of powder metallurgy techniques and, in certain embodiments thereof of forming a heat or quench hardenable steel. The present invention also relates to an improved sintering method for powder metallurgy techniques.

One method of making hardenable steel is described in U.S. Pat. No. 3,150,444 granted Sept. 29, 1964 to Orville W. Reen. This patent discloses the making of a heat hardenable steel using powder techniques wherein an atomized pre-alloyed powder is compressed and then sintered in the presence of a carbonaceous reducing agent. The sintered product is also mechanically worked so as to effect a density substantially equivalent to the steel in its cast and wrought state.

Alloys of the type to which the present invention relates contain carbon ranging between about 0.6 to 5.0% by weight. In accordance with the teachings of the aforementioned patent, the metal powders employed are alloyed prior to sintering. That is to say the base metal or metals are melted with the alloying elements to form the desired alloy and thereafter atomized.

The alloyed powders containing the requisite carbon content to form the desired alloy are extremely hard and abrasive. The Reen patent teaches that these hard powders are not easily compressed. In fact, it is believed that even after annealing, the powders retain their abrasiveness and hardness and thereby limit cold compactibility. It should be readily apparent that this patented method has the disadvantage of producing an abrasive powder which required annealing to render it more suitable for compaction.

By the present invention, it is proposed to provide an improved method of forming a high carbon, hard alloy using a powder metal technique which is simpler to perform and which will yield uniform predictable results.

Another feature of the invention is directed to a method of sintering a powder metal high carbon, hard alloy to substantially full density.

In one embodiment of the invention, the method is directed to the formation of a high carbon, heat hardenable steel.

This is accomplished by a method wherein a powdered metal is formed by atomization of metal composition containing the elements for forming the desired alloy, but low in carbon content which may be maintained below 0.2% by weight. The resulting powdered metal thus formed with the carbon maintained at a minimum is readily compactible without annealing. The carbon required to obtain the desired analysis is provided by lampblack or graphite which is blended with the powder metal. The blended powder metal and carbon is then compacted and sintered so that the lampblack or graphite is diffused into the metal powder. Additional carbon to that required to achieve the desired alloy analysis may be provided to compensate for oxygen reduction which occurs during sintering as a result of the reaction of carbon with oxide formed during atomization of the powder metal. The lampblack or graphite added may vary from about 0.6 to 5.0% by weight of the blend to be compacted: of this amount of carbon from about 0.6 to 4.5% by weight is added to achieve the desired product analysis while 0% to about 0.5% carbon may be included to compensate for the oxygen reduction.

The metal powders blended with the lampblack or graphite form hard and abrasion resistant products, and contain alloying quantities of one or more of the elements chromium, vanadium, tungsten and molybdenum so that a hard carbide is formed with such element or elements. In preferred embodiments, the alloy contains a quantity of iron so that complex carbides of iron with one of the elements, chromium, vanadium, tungsten or molybdenum may be formed.

In accordance with another aspect of the invention, the compact is sintered at a temperature just above the solidus temperature for the alloy. It has been found that a "high density" alloy will result; that is, as herein used, of such density that no further densification as by peening or forging is required for use. Density in the range of 97% to 100% of theoretical density may be considered high density. It has been found that at such sintering temperature, distortion is minimal (i.e. the parts retain their shape) and dimensional shrinkage is predictable so that finished products can be produced and held within the desired dimensional tolerances without further processing.

BRIEF DESCRIPTION OF THE DRAWING

The drawing is a phase diagram in relation to the carbon content of a typical high carbon hard alloy, and specifically for a M2 tool steel having by weight 6% tungsten, 5% molybdenum, 2% vanadium and 4% chromium.

DESCRIPTION OF SPECIFIC EMBODIMENTS

Tool Steels

One suitable alloy class formed comprises heat hardenable alloy tool steels wherein the powder metals to be blended with the lampblack or graphite have the following analysis:

| | |
|---|---|
| Carbon | About 0.2% |
| Silicon | About 1% |
| Manganese | About .25% |
| Sulfur | About .04% (0.05 to 0.5% for free machining grades) |
| Phosphorus | About 0.04% maximum |
| Chromium | About 2 to 9% |
| Vanadium | About 0.5 to 7% |
| Cobalt | Optional up to about 15% |
| Tungsten | Optional up to about 24% |
| Molybdenum | Optional up to about 12% |
| Iron | Balance |

Atomization of the composition is carried out in the well-known manner in which a molten stream of the composition is poured through an area wherein it is impinged by a fluid such as liquid, as for example water; or gas, as for example steam; nitrogen; compressed air and the like. The impingement serves to disperse the falling molten metal into fine particles which drop into a liquid medium such as water wherein the particles are quenched. The size and contour of the particles may be controlled by conventional and well-known means. The composition of the metal powder thus formed in accordance with the present invention has less than about 0.2% carbon content. In the absence of a substantial quantity of carbon in the particles, the formation of any significant amount of hard carbides in a ferrite matrix does not occurs as in the prior method described in the aforementioned patent.

The required carbon, in the form of lampblack or graphite to achieve the desired tool steel composition is then blended with the metal powder. This blend of powder metal and carbon contains at least sufficient carbon to produce a compacted product having the desired tool steel analysis. To this end, at least about 0.6% by weight of lampblack or graphite is blended with the powder metal. Generally the amount of lampblack or graphite added will be in excess of that required to achieve the desired analysis in the final composition. The excess carbon is used during sintering to reduce the oxides formed on the particles during atomization.

The blend of the metal powder and carbon is cold compacted at compacting pressures of about 20 to 60 tsi in a die having a suitable lubricant on the die wall. As an alternative, the powder may be mixed with a lubricant, for example ¾% by weight Acrawax "C" made by Glyco Chemical Co., and no die wall lubrication is necessary. The shape of the article to be formed from the powder metal blend determines the particular method of compaction or die shape to be used.

Conventionally, the compacted blend would initially preferably be sintered in a hydrogen or non-oxidizing atmosphere or in a vacuum at a temperature ranging between about 2000° and 2200°0 F. for sintering to occur. In accordance with the present invention it has been found that the graphite will diffuse into the powder metal particles. The sintered compacts may thereafter be peened to densify the surface and thereby to minimize oxidation which occurs during the preheating for forging as more fully to be explained hereinafter. The compacts which are intended for use as a tool, for as example as a gear hob, tool bit and the like are further compressed into greater density and shaped into the desired configuration by forging. The compacts are preheated in suitable atmosphere for forging at a temperature of between about 2000° F. to 2150° F. and thereafter forged. After forging, the articles are heat treated at temperatures and periods to achieve a desired range of hardness. The final hardness and mechanical characteristics are achieved by well-known quench hardening and tempering procedures.

In accordance with another feature of the present invention, sintering can be carried out just above the solidus temperature where there is a sufficient amount of liquid phase present so that a high density sintered compact will result. Thus it has been found that test sintering various heats of M2 tool steel between the solidus and liquidus temperature will result in a high density alloy as follows:

| Heat | Chemical Analysis of M2 Heat | | | | | | | % Theoretical Density | |
|---|---|---|---|---|---|---|---|---|---|
| | | | | | | | | 2240° F | 2260° F |
| No. | C | Mn | Si | Cr | V | W | Mo | 5 hrs. | 5 hrs. |
| 1 | 1.04 | .07 | 1.04 | 4.0 | 2.2 | 6.2 | 4.7 | | 97 |
| 2 | 1.15 | .06 | .76 | 3.8 | 2.2 | 6.5 | 4.8 | | 97 |
| 3 | 1.16 | .05 | 1.22 | 3.8 | 2.3 | 6.8 | 4.9 | 98 | 97 |
| 4 | 1.18 | .03 | 1.05 | 3.9 | 2.3 | 6.5 | 5.0 | 98 | 97 |

The following are specific examples of the method of the present invention applied to tool steels:

EXAMPLE NO. 1

1. A heat of steel corresponding to an AISI M2 high speed steel composition except for carbon content was water atomized and screened into a −100 mesh powdered metal having the following analysis:

| | | | |
|---|---|---|---|
| C | -0.023% | Mo | -4.60% |
| Mn | -0.24% | V | -1.87% |
| Si | -0.68% | W | -6.48% |
| P | -0.009% | $O_2$ | -0.15% |

2. The powdered metal was blended with 1.00% by weight natural graphite to achieve the necessary carbon content to form the desired tool steel composition. The powdered metal was cold compacted in a closed die at 60 tsi using a molybdenum disulfide grease as a die wall lubricant. The powder metal was compacted into blanks of 3½ inches in diameter by 1¼ inches high. The density of the blanks was about 6.5 gm/cc or 80% of the theoretical density.

3. The blanks were heated in a hydrogen atmosphere to 1800° F., held for one-half hour to equalize temperature, and sintered at 2100° F. for one hour at temperature.

4. The sintered blanks were shot peened for 10 minutes to densify the surface and minimize internal oxidation during preheating of the blanks for forging.

5. The blanks were preheated in air for forging in the temperature range of 2000° F. to 2100° F.

6. They were forged on a high energy rate forging press to a final density of 8.09 gm/cc (99.3% theoretical).

7. Thereafter the forged blanks were annealed at 1600° F.–1650° F. for four (4) hours and allowed to slow cool. Annealed hardnesses ranged from Rockwell C 15–25.

8. The blanks were preheated for hardening at 1500° F. for 30 minutes, austenitized at 2250° F. for 4 minutes, and oil quenched.

9. The blanks were double tempered at 1025° F. for two (2) hours.

Hardened properties included:

Hardness — Rc 65

Intercept grain size — 25

The resulting tool steel is capable of being used as gear hobs, cutters, mills and the like.

EXAMPLE NO. 2

1. A heat of steel corresponding to an AISI M2 high speed (represented by Heat No. 1 in the preceding table) except for carbon content was water atomized and screened into a −100 mesh powder having the following analysis:

| | |
|---|---|
| C -0.03% | Mo-4.7% |
| Mn-0.07% | V -2.2% |
| Si-1.04% | W 6.2% |
| Cr-4.0% | $O_2$-.20% |

2. The powder was blended with 1.15 percent by weight natural graphite (1.0% to meet analysis specification and 0.15% to compensate for oxygen reduction) 0.1% molybdenum disulfide lubricant was also added to the blend with 1% Acrawax C.

3. The powder was cold compacted at 50 tsi into blanks one inch in diameter by one inch thick. The density of the blanks was about 6.3 gm/cc or 77% of theoretical density.

4. The blanks were burned off at 900° F. for 60 minutes under an atmosphere of nitrogen (1 psi gage pressure).

5. The compact was then sintered at 2260° F. for 5 hours in a vacuum. The sintering temperature selected was just above the solidus line into the liquid + austenite + carbide region of the phase diagram. As appears from the drawing, the solidus point for a similar steel at the final carbon content of 1.04% is approximately 2240° F.; the liquidus point is approximately 2600° F.

6. Cooling from the sintering temperature was carried on by gas fan cooling with low dew point nitrogen.

A heat density tool steel product resulted with minimum distortion of shape such that a finished product is produced within usable tolerances without further processing of the sintered compact. Holding at an intermediate temperature to equalize the temperature throughout the load during sintering, as in Example No. 1, did not appear necessary. The density was 7.9 gm/cc or about 97% of theoretical.

EXAMPLE NO. 3

1. A heat of steel corresponding to an AISI M2 high speed tool steel composition except for carbon content was water atomized and screened into a −40 mesh powder having the following analysis:

| | |
|---|---|
| C -0.052% | Mo-4.91% |
| Mn-0.33% | V -1.93% |
| Si-0.92% | W -6.48% |
| Cr-4.46% | $O_2$-0.20% |

2. The −40 mesh powder was blended with 1.10 percent, by weight of natural graphite, (0.95% to meet analysis specification and 0.15% to compensate for oxygen reduction). The powder blend was processed as follows:

3. The powder was cold compacted at 50 tons per square inch using a molybdenum sulfide grease as a die wall lubricant into blanks of the following dimensions:

| Dia | Height | Weight | Density |
|---|---|---|---|
| 3" | 5" | 8 lbs. | 6.3 gm/cc (77% of theoretical) |

4. The blanks were sintered in vacuum as described below:

(a) 1800° F. for one (1) hour to equalize the temperature throughout the load.
(b) 2100° F. for one and one-half hour at temperature.
(c) Cooled to 1600° F. and held for one hour.
(d) Rapid cool to room temperature using nitrogen backfill system.
(e) Vacuum level maintained at 100 microns or less.

5. Blanks were shot peened for 15 minutes to densify the surface.

6. Preheated for forging in air at 1500° F.–1600° F. and then at 2000° F.–2100° F. for 10 minutes maximum time.

7. High energy rate forged to 8.05 gm/cc (99% theoretical).

EXAMPLE NO. 4

A lot of water atomized powder having the same analysis as described in Example No. 3 was processed as follows:

1. Blended with 1.10 percent by weight natural graphite (0.95% to meet chemistry specification and 0.15% to account for oxygen reduction), plus 1 percent by weight "Acrawax C" as a lubricant.
2. The powder blend was cold compacted at 50 tons per square inch into a blank 3 inch long by ½ inch wide by 9/10 inch thick bar weighing about 140 grams. The green density was 6.5 gm/cc (80% theoretical density).
3. The blanks were burned off at 1000° F. for 1 hour in nitrogen.
4. The blanks were sintered in vacuum as described:
(a) Heat to 1800° F. hold for 30 minutes.
(b) 2100° F.–60 minutes
(c) 1400° F.–2 hours
(d) Backfill with nitrogen
5. Shot peened for 6 minutes.
6. Preheated in 2250° F. furnace for 5 minutes in argon to heat blanks to 2100° F.–2150° F.
7. Forged in a closed die under 3 conditions, no lateral flow, 10% lateral flow, and 20% lateral metal flow. Final densities were:

| Condition | Density |
|---|---|
| No flow | 7.96 gm/cc (97.3% theoretical) |
| 10% lateral flow | 8.00 gm/cc (98.1% theoretical) |
| 20% lateral flow | 8.05 gm/cc (99% theoretical) |

8. Annealed at 1650° F. for 4 hours to a hardness of Rockwell C20.
9. Preheated for hardening at 1500° F.–1600° F. for 30 minutes, then austenitized at 2225° F. for 4 minutes and oil quenched.
10. Tempered 1025° F. for 2 hours.
11. Cooled in liquid nitrogen for 30–60 minutes.
12. Double tempered 1025° F. for 2 hours.

EXAMPLE NO. 5

A heat of steel corresponding to an AISI T15 high speed tool steel composition except for carbon content was water atomized and screened into a −100 mesh powder having the following analysis:

| | |
|---|---|
| C -0.042% | V -4.25% |
| Mn-0.26% | Co-4.71% |
| Si-0.76% | W -12.71% |
| Cr-4.05% | $O_2$-0.45% |

The −100 mesh powder was blended with 1.90 percent by weight natural graphite (1.57% to meet chemistry specification of tool steel desired and 0.33% to compensate for oxgyen reduction). The blended powder was processed as follows:

1. The blend mixed with 1 percent by weight "Acrawax C" to act a lubricant.
2. The powder was cold compacted at 50 tons per square inch into ½ × 3 9/10 inch bars weighing 140 grams. The blank density was 6.4 gm/cc (77% theoretical density).
3. The lubricant was burned off at 1000° F. for 1 hour in nitrogen.

4. The blanks were sintered in vacuum maintained at 100 microns or below as described:
   (a) Heated to 1800° F. for 30 minutes.
   (b) 2100° F.–60 minutes
   (c) 1400° F.–2 hours
   (d) Backfill with nitrogen
5. Shot peened for 6 minutes to densify to surface to minimize internal oxidation during preheating for forging.
6. The shot peened blank was preheated between about 2100° F.–2150° F. in an inert atmosphere.
7. Forged
8. Annealed
9. Hardened and tempered

EXAMPLE NO. 6

A blend of powder having the chemical analysis as Example No. 3 was processed as follows:

1. Blended with 1.3 percent (by weight) natural graphite and 1 percent (by weight) "Acrawax C" for lubrication.
2. Cold compacted at 50 tons per square inch into 1 inch diameter by 0.8 inch thick slugs, weighing 45 grams to provide a density of 6.3 gm/cc or about 77% of theoretical density.
3. Burned off 1000° F. for one hour in nitrogen.
4. Sintered as follows:

Slugs were inserted into a hydrogen atmosphere furnace at 2260° F., held one hour, and rapid cooled. The result was a high density, finished product with usable tolerances, having a density of 7.9 gm/cc or about 97% of theoretical density.

High Carbon Stainless Steels

Another suitable steel alloy formed is a heat hardenable, high carbon stainless steel such as that used for cutlery corresponding to an AISI 440C steel. The steel is characterized by a high carbon content in the range of about 0.6 to 1.25% by weight and a high chromium content in the range of about 12 to 27% by weight. The steel is processed in similar manner as the tool steel described above.

A heat hardenable high carbon stainless steel may have the following composition:

| | |
|---|---|
| Carbon | About 0.5 to 1.25% |
| Manganese | About 1.0% maximum |
| Silicon | About 1.0% maximum |
| Chromium | About 12% to 27% |
| Molybdenum | About 0.75% maximum |
| Iron | Essentially balance |

The following is a specific example of the method of the present invention for producing a heat treatable stainless steel 440C steel:

EXAMPLE NO. 7

1. A heat of steel corresponding to an AISI 430 stainless powder was water atomized and screened into a −100 mesh powder metal, having a composition corresponding to the desired 440C stainless steel except for carbon content. The powder metal had the following analysis:

| | |
|---|---|
| Carbon | - .02% |
| Manganese | - .17% |
| Silicon | - .98% |
| Chromium | - 16.2% |

-continued

| | |
|---|---|
| Iron | - essentially balance |

2. The powder metal is blended with 1.00% by weight natural graphite to achieve carbon content to form the desired heat treatable stainless steel composition. A molybdenum disulfide grease is used as a die wall lubricant. The powder metal is then cold compacted in a closed die at 50 tsi into blanks 3½ inches high.
3. The lubricant was burned off between 800° to 1200° F. for one hour in nitrogen.
4. The blanks were then sintered in a vacuum at 1800° F. for 10 minutes and then at 2200° F. for 60 minutes, with a partial pressure of nitrogen of 500 microns. The blanks were then cooled in nitrogen atmosphere.
5. Thereafter the sintered blanks were hardened by heating to 1850° F., holding for 30 minutes at temperature, rapidly cooling to room temperature followed by heating to a temperature between 300° and 400° F., holding for 120 minutes and cooling to room temperature.

The properties of the sintered blanks included:

| | | |
|---|---|---|
| Density | 6.1 gm/cc | 79% of theoretical density |
| Particle Hardness | Rc 58 | |

The heat hardenable, high carbon stainless steel according to the present invention is suitable for cutlery and other purposes.

EXAMPLE NO. 8

Compacted blanks were prepared and the lubricant burned off in like manner as set forth in Example No. 7 above.

The blanks were then vacuum sintered at 2390° F., just above the solidus temperature, with a partial pressure of nitrogen.

High density products were produced with good dimensional control.

Non-Ferrous Alloys

The process according to the present invention may be applied to high carbon non-ferrous base alloys which have the necessary alloying components to form the hard carbides of such elements as chromium, vanadium, tungsten and molybdenum. Iron also will form hard carbides and may be a desired alloying element of an essentially non-ferrous base alloy.

One alloy which may be made by the present method is a nickel-chromium alloy known commercially as Eatonite and having a final composition as follows:

| | |
|---|---|
| Carbon | About 2.0 to 2.75% |
| Manganese | About .025% |
| Silicon | About 1.5% maximum |
| Chromium | About 27 to 31% |
| Nickel | About 37 to 41% |
| Iron | About 7% maximum |
| Tungsten | About 14 to 16% |
| Cobalt | About 9 to 11% |

EXAMPLE NO. 9

1. A heat of alloy known as Eatonite but with carbon omitted was water atomized and screened into a −100 mesh powder metal having the following composition:

| | |
|---|---|
| Carbon | .02% |
| Manganese | .024% |
| Silicon | 0.86% |
| Chromium | 29.8% |
| Nickel | 39.3% |
| Iron | 4.1% |
| Tungsten | 15.1% |
| Cobalt | 10.4% |

2. The powder was blended with 2.5% by weight natural graphite and 1% lubricant such as Acrawax "C". The powder metal was cold compacted in a closed die at 60 tsi. The powder metal was compacted into blanks of 1 inch in diameter and three-eighths inch thick.

3. The lubricant was burned off at 1000° F. for 60 minutes in nitrogen.

4. The blanks were sintered at 2260° F. for 120 minutes.

The properties of the blanks included:

| | |
|---|---|
| Particle Hardness | Rc 47 to 53 |
| Density | 7.22 gm/cc, 81% theoretical density |

What is claimed is:

1. The method of producing a high carbon, heat and abrasion resistant alloy having a final composition including at least 1% of at least one of the elements of the group consisting of chromium, vanadium, molybdenum and tungsten, the elements of this group being characterized by a major portion of the carbides thereof remaining undissolved at elevated temperatures, said method comprising the steps of:

atomizing a melt having an initial composition which includes at least 1% of one of the elements of the group consisting of chromium, vanadium, molybdenum and tungsten and a carbon content of less than 0.2% thereby to limit the formation of the carbides of said elements of said group to a level substantially below that present in said final composition and thereby to form a cold compactible powder, blending said cold compactible powder with carbon particles of sufficient quantity to form a blend which has a final composition of at least about 0.6% carbon, without further treatment compressing said blend into a green compact blank at a pressure in excess of 20 tsi; and heating said green compact blank at a temperature and for a time sufficient to cause carbon diffusion and thus to provide carbides of at least some of the elements of said group of a quantity sufficient to impart hardness and abrasion resistance to said final composition.

2. The invention as defined in claim 1 wherein said blank is heated to a temperature between the solidus and liquidus temperature to form a minimal amount of liquid phase and for a time sufficient to achieve a density substantially equal to the theoretical density of the alloy being formed.

3. The method as defined in claim 1 wherein said alloy is a heat hardenable tool steel having a composition which comprises the following anaylsis ranges:

| | |
|---|---|
| Carbon | About 0.6 to 2.0% |
| Silicon | About 1% |
| Manganese | About .25% |
| Sulfur | About .04% maximum |
| Phosphorus | About .04% maximum |
| Chromium | About 2. to 9% |
| Vanadium | About 0.5 to 7% |
| Cobalt | Optional up to about 15% |
| Tungsten | Optional up to about 24% |
| Molybdenum | Optional up to about 12% |
| Iron | Essentially balance |

4. The method as defined in claim 1 wherein said alloy is a heat hardenable stainless steel having a composition which comprises the following analysis ranges:

| | |
|---|---|
| Carbon | About 0.6 to 1.25% |
| Manganese | About 1.0% maximum |
| Silicon | About 1.0% maximum |
| Chromium | About 10 to 27% |
| Iron | Essentially balance |

5. The method as defined in claim 1 wherein said alloy is a high carbon, hard, nickel base composition having a composition which comprises the following analysis ranges:

6. The method as defined in claim 1 wherein said sintered and compacted powder blank is mechanically worked to attain substantially full density.

| | |
|---|---|
| Carbon | About 2 to 2.75% |
| Silicon | About 1.5% maximum |
| Chromium | About 2.7 to 3.1% |
| Nickel | About 37 to 41% |
| Iron | Optional up to 8.0% maximum |
| Cobalt | About 9 to 11% |

7. The method as defined in claim 1 wherein said carbon particles consist of one of the group selected from lampblack and graphite.

8. The method of claim 3 wherein said heating step comprises heating said compacted powder at a temperature of about 2200° F. to 2300° F.

9. The method as defined in claim 1 wherein the initial composition of said melt includes at least 1% iron, and the conversion of said elements from said group consisting of chromium, vanadium, molybdenum and tungsten includes conversion of at least some of said iron into complex carbide of iron with at least one of said elements from said group.

10. The method as defined in claim 1 wherein the initial composition of said melt is an iron base alloy, and the conversion of said elements from said group consisting of chromium, vanadium, molybdenum and tungsten includes conversion of at least some of said iron into complex carbide of iron with at least one of said elements from said group.

11. The method as defined in claim 8 wherein said heating is for a period of approximately 10–600 minutes.

* * * * *